US010988851B2

(12) United States Patent
Choi

(10) Patent No.: US 10,988,851 B2
(45) Date of Patent: Apr. 27, 2021

(54) METHOD FOR MANUFACTURING COMPOSITION CONTROLLED THIN ALLOY FOIL BY USING ELECTRO-FORMING

(71) Applicant: DANKOOK UNIVERSITY CHEONAN CAMPUS INDUSTRY ACADEMIC COOPERATION FOUNDATION, Cheonan-si (KR)

(72) Inventor: Yong Choi, Chungcheongnam-do (KR)

(73) Assignee: DANKOOK UNIVERSITY CHEONAN CAMPUS INDUSTRY ACADEMIC COOPERATION FOUNDATION

( * ) Notice: Subject to any disclaimer, the term of this patent is extended or adjusted under 35 U.S.C. 154(b) by 251 days.

(21) Appl. No.: 15/757,342

(22) PCT Filed: Sep. 2, 2016

(86) PCT No.: PCT/KR2016/009877
§ 371 (c)(1),
(2) Date: Mar. 2, 2018

(87) PCT Pub. No.: WO2017/039402
PCT Pub. Date: Mar. 9, 2017

(65) Prior Publication Data

US 2018/0237928 A1 Aug. 23, 2018

(30) Foreign Application Priority Data

Sep. 2, 2015 (KR) ..... 10-2015-0124209

(51) Int. Cl.
*C25D 1/04* (2006.01)
*C25D 5/14* (2006.01)
(Continued)

(52) U.S. Cl.
CPC ..... *C25D 1/04* (2013.01); *C22F 1/08* (2013.01); *C23F 17/00* (2013.01); *C25D 3/20* (2013.01);
(Continued)

(58) Field of Classification Search
CPC ... C25D 1/04; C25D 5/20; C25D 5/50; C25D 5/14; C25D 5/18; C25D 7/06; C25D 3/58;
(Continued)

(56) References Cited

U.S. PATENT DOCUMENTS 2,026,605 A * 1/1936 Antisell ..... C25D 5/10 148/518
2,533,532 A * 12/1950 Stoddard, Jr. ..... C25D 3/12 205/82
(Continued)

FOREIGN PATENT DOCUMENTS

JP 07014738 A * 1/1995 ..... B82Y 25/00
JP 10280184 A 10/1998
(Continued)

*Primary Examiner* — Louis J Rufo
(74) *Attorney, Agent, or Firm* — Renaissance IP Law Group LLP

(57) ABSTRACT

Disclosed is a method of manufacturing various alloy thin films, in which nano-scale cracks are controlled, with desired compositions using an ultrasonic pulse electroforming process. The method includes a step of forming a multilayer that includes two or more different thin metal film layers, in which nano-scale cracks due to hydrogen generation are controlled, a step of ultimately facilitating interdiffusion by controlling the thickness of the multilayer to a nano-scale thickness through pulse application and the number of layers forming the multilayer, and controlling an alloy to have a desired composition through heat treatment, and a step of thermally treating the multilayer such that interdiffusion sufficiently occurs among the two or more different
(Continued)

thin metal film layers. The step of thermally treating may be carried out along with rolling, whereby very fine cracks may be removed by compression and, accordingly, alloy foils having various compositions may be economically produced. A layer number and thickness of the multilayer may be controlled to a nano-sized thickness by applying various types of pulses or by connecting a plurality of electrolytic cells in series and stepwise or repeatedly transferring adding an electroforming layer to the electrolytic cells under a DC application condition.

2 Claims, 11 Drawing Sheets

(51) Int. Cl.

| | |
|---|---|
| ***C25D 5/18*** | (2006.01) |
| ***C25D 5/50*** | (2006.01) |
| ***C25D 7/06*** | (2006.01) |
| ***C22F 1/08*** | (2006.01) |
| ***C23F 17/00*** | (2006.01) |
| ***C25D 3/20*** | (2006.01) |
| ***C25D 5/20*** | (2006.01) |
| ***C25D 3/12*** | (2006.01) |
| ***C25D 3/38*** | (2006.01) |
| ***C25D 3/58*** | (2006.01) |

(52) U.S. Cl.
CPC ..... *C25D 5/14* (2013.01); *C25D 5/18* (2013.01); *C25D 5/20* (2013.01); *C25D 5/50* (2013.01); *C25D 7/06* (2013.01); *C25D 3/12* (2013.01); *C25D 3/38* (2013.01); *C25D 3/58* (2013.01)

(58) Field of Classification Search
CPC ... C25D 3/38; C25D 3/12; C23F 17/00; C22F 1/08
See application file for complete search history.

(56) References Cited

U.S. PATENT DOCUMENTS

| | | | | |
|---|---|---|---|---|
| 2,714,089 | A * | 7/1955 | Meyer | C25D 3/20 205/270 |
| 2012/0088118 | A1* | 4/2012 | Lomasney | C25D 5/10 428/615 |
| 2017/0191178 | A1* | 7/2017 | Lomasney | C25D 5/56 |

FOREIGN PATENT DOCUMENTS

| | | | |
|---|---|---|---|
| JP | 3116125 | B2 | 12/2000 |
| KR | 20020042680 | A | 6/2002 |
| KR | 20030048110 | A | 6/2003 |
| WO | 2015065150 | A1 | 5/2015 |

* cited by examiner

METHOD FOR MANUFACTURING COMPOSITION CONTROLLED THIN ALLOY FOIL BY USING ELECTRO-FORMING

TECHNICAL FIELD

The present invention relates to the field of manufacturing an alloy thin film, and more particularly, to a method of manufacturing alloy thin films having various compositions through electroforming and heat treatment.

BACKGROUND ART

In general, metal foils are manufactured in a rolling process and a plating process. Although a rolling process is advantageous for mass production, it is difficult to obtain a uniform thickness when a metal foil having a thickness of tens of micrometers is manufactured in the rolling process, and a tip of a foil is easily damaged due to metallographic parameters, such as elongated grains, texture formation, and work hardening effect. In addition, since it is difficult to provide uniform mechanical characteristics, the thickness of a thin film is limited. In particular, since it is more difficult to produce an alloy foil with a thickness of tens of micrometers in a rolling process due to metallographic parameters, compared to mass production of a pure metal foil, more sophisticated process conditions are required, resulting in high production costs and limited thickness.

As a representative example of plating processes of manufacturing a metal foil, there is an electroforming process. An electroforming process is characterized by plating a plating solution containing a metal ion solution in a thin metal plate form to a thickness of several tens to several hundred micrometers on a surface of a rotating circular metal anode and then detaching the same, thereby continuously manufacturing a thin plate.

Due to use of such a plating solution, desorption of hydrogen gas is poor due to reduction of hydrogen ions, which causes the generation of nanometer-scale cracks inside a plating layer. In addition, since reduced metal ions in a plating solution are decreased when a thin metal plate is continuously produced, a plating solution should be supplemented with metal ions to be reduced such that concentration is constantly maintained so as to continuously produce a metal having a uniform composition. An electric potential may be relatively easily controlled and single-metal ions may be relatively easily supplemented by controlling poor desorption of hydrogen gas and the concentration of metal ions in an electroforming process to manufacture a single-metal foil. Accordingly, an electroforming process is economically advantageous in manufacturing a foil with a thickness of tens of micrometers, compared to a rolling process. However, upon production of an alloy foil in an electroforming process, it is very difficult to desorb hydrogen gas and control the composition of a solution due to different reduction potentials of metal ions. In particular, there are problems in producing a multi-component alloy foil having a desired composition in an electroforming process.

DISCLOSURE

Technical Problem

Therefore, the present invention has been made in view of the above problems, and it is one object of the present invention to provide a method of manufacturing alloy thin films with desired various compositions through diffusion by an electroforming process using current density having various pulse waveforms and electric potentials and heat treatment.

It is another object of the present invention to provide an economical method of manufacturing an alloy thin film which allows diffusion at a relatively low temperature by thermally treating a sandwich-type multi-layered film with a nano-scale thickness while rolling the same.

Technical Solution

The present invention provides a method of manufacturing an alloy thin film according to the present invention, the method comprising (a) a step of forming a multilayer that includes two or more different thin metal film layers while facilitating hydrogen gas desorption by applying various types of pulse current density; and (b) a step of thermally treating the multilayer during or after an electroforming process such that interdiffusion occurs among the two or more different thin metal film layers.

In step (a), the multilayer is formed simultaneously using electroplating and ultrasonic pulse application.

Alternatively, in step (a), a layer number and thickness of the multilayer may be controlled by connecting a plurality of electrolytic cells in series and stepwise or repeatedly transferring and adding an electroforming layer to the electrolytic cells under a DC application condition.

In the thermally treating of step (b), rolling may be carried out during or after the electroforming process.

The multilayer of step (a) may be an alloy formed by alternately, repeatedly laminating thin layers formed of different metals, an alloy formed through interdiffusion during an electroforming process, or an alloy whose formation is facilitated by rolling during an electroforming process.

Each of the thin layers formed of different metals may be laminated by applying different current densities, voltages, and pHs.

Advantageous Effects

In accordance with the present invention, alloy thin films having various compositions can be manufactured in an economical manner. For example, according to the present invention, various alloy foils having desired compositions and nano-scale thicknesses can be manufactured by (1) forming various types of metal multilayers through an electroforming process, in which pulses are applied, followed by heat treatment or (2) by forming a nano-scale metal multilayer using a pulse voltage and, simultaneously, rolling the formed nano-scale metal multilayer, preferably by thermally treating along with the rolling. Accordingly, compared to a conventional mechanical foil manufacture technology in which rolling is only performed, manufacture of a very thin film is possible and multi-component alloy foils having various compositions can be manufactured.

MODES OF THE INVENTION

Exemplary embodiments of the present invention are described in detail with reference to the accompanying drawings. In the following description of the present invention, a detailed description of known functions and configurations incorporated herein will be omitted when it may make the subject matter of the present invention unclear.

First of all, the present invention provides an alloy thin film having a desired composition and thickness by forming a metal multilayer in an electroforming process and then thermally treating the multilayer at a temperature at which interdiffusion occurs. The multilayer may be manufactured through multi-stage pulse plating corresponding to the number of layers thereof. Preferably, the multilayer may have a structure consisting of two or more layers for forming a binary alloy, three or more layers for forming a ternary alloy, or the like, or may be simultaneously alloyed by voltage and temperature application during an electroforming process. Subsequently, the multilayer is thermally treated in a temperature range at which interdiffusion occurs, thereby obtaining an alloy. More preferably, when the multilayer is heated while rolling during or after an electroforming process, diffusion may occur at relatively low temperatures. Accordingly, tens of nanometer-sized internal cracks due to poor hydrogen gas desorption may be removed by compression while controlling the thickness of a foil, whereby an alloy foil having superior texture may be manufactured and, compared to a mechanical rolling process, an alloy may be produced very economically.

Hereinafter, the method of manufacturing an alloy thin film according to the present invention is described in with reference to the accompanying drawings.

Figure 1:
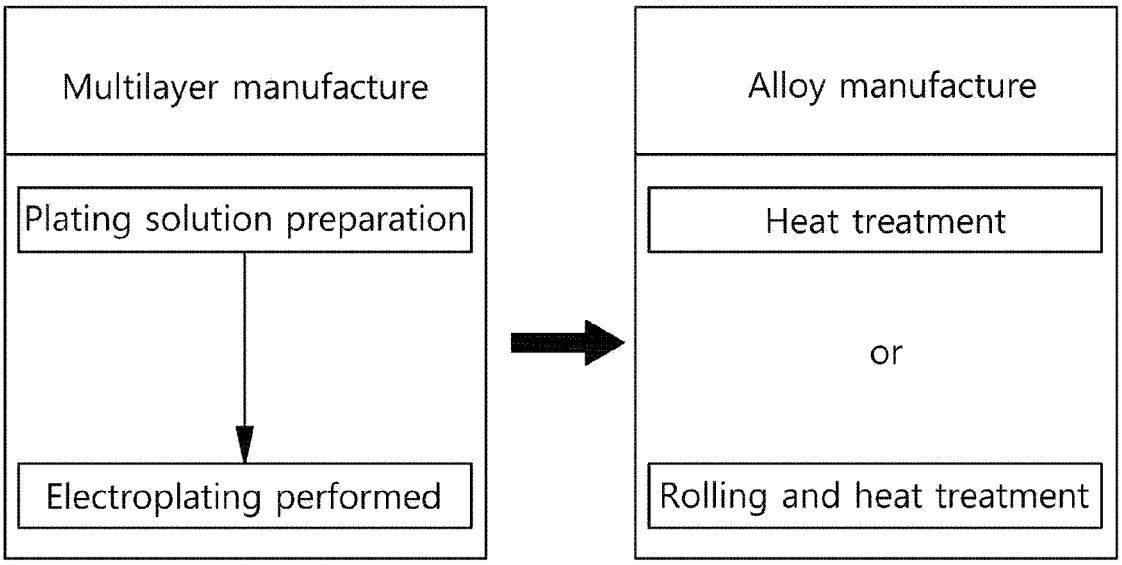
FIG. 1 is a block diagram illustrating a process flow of a method of manufacturing an alloy thin film according to the present invention.
Figure 2:
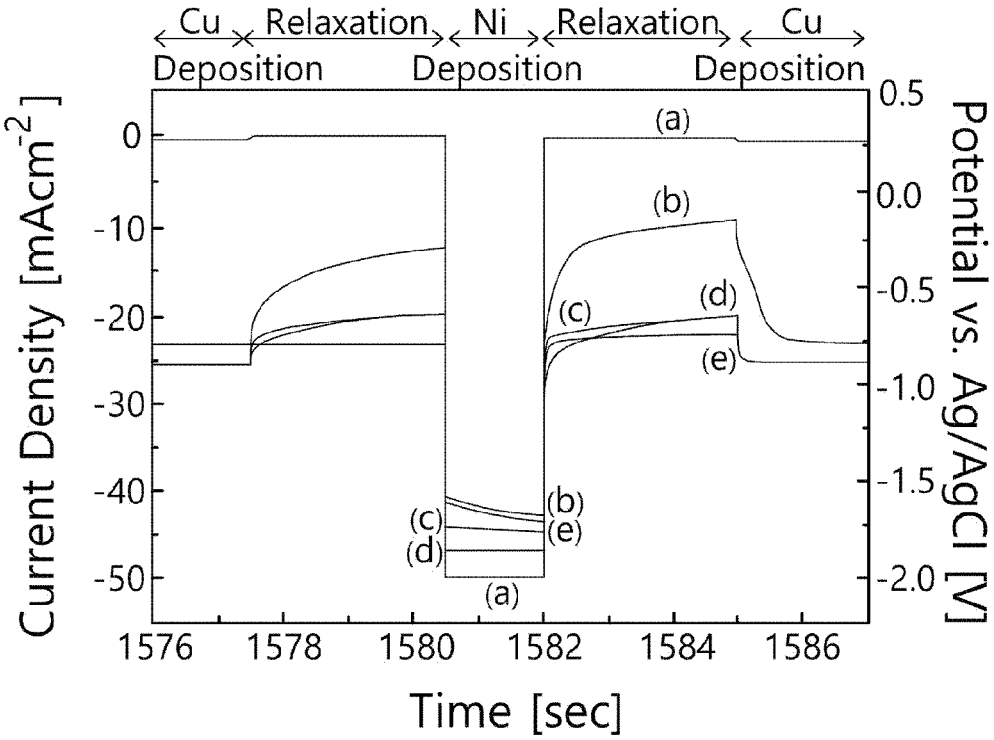
FIG. 2 is a drawing illustrating pH-dependent pulse-relaxation current density variation of a solution used to form a copper-nickel multilayer.
Figure 3A:
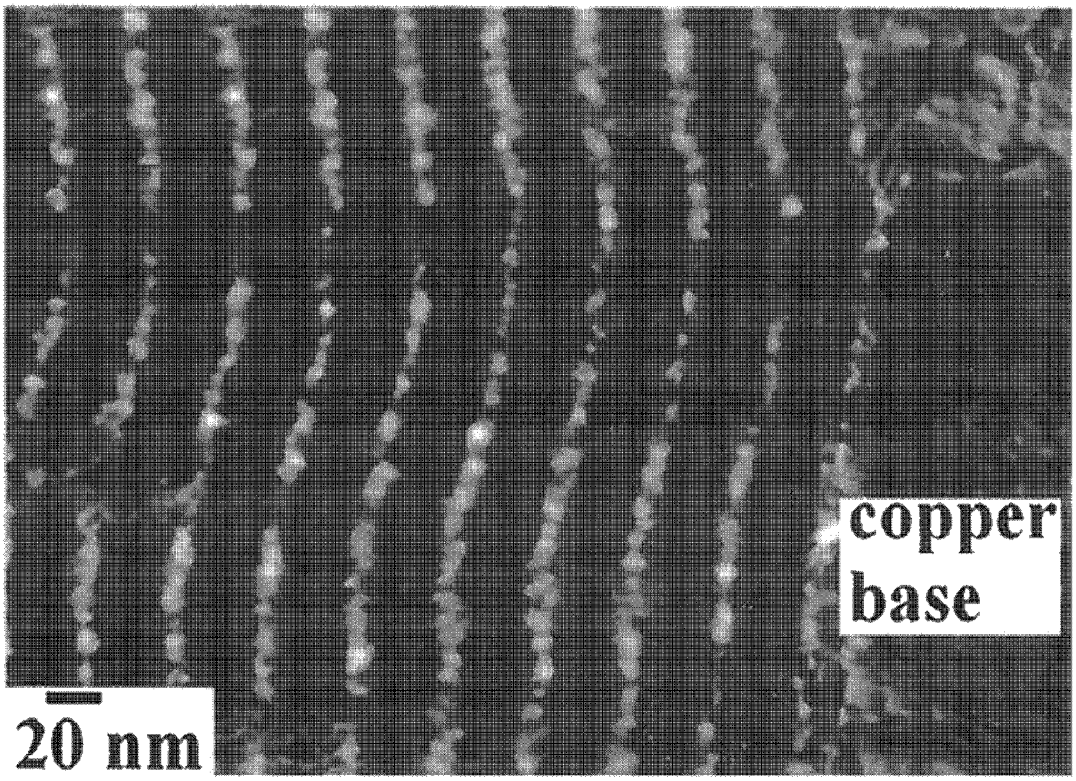
FIGS. 3*a* to 3*d* illustrate transmission electron microscopy (TEM) images of a copper-nickel multilayer.
Figure 3B:
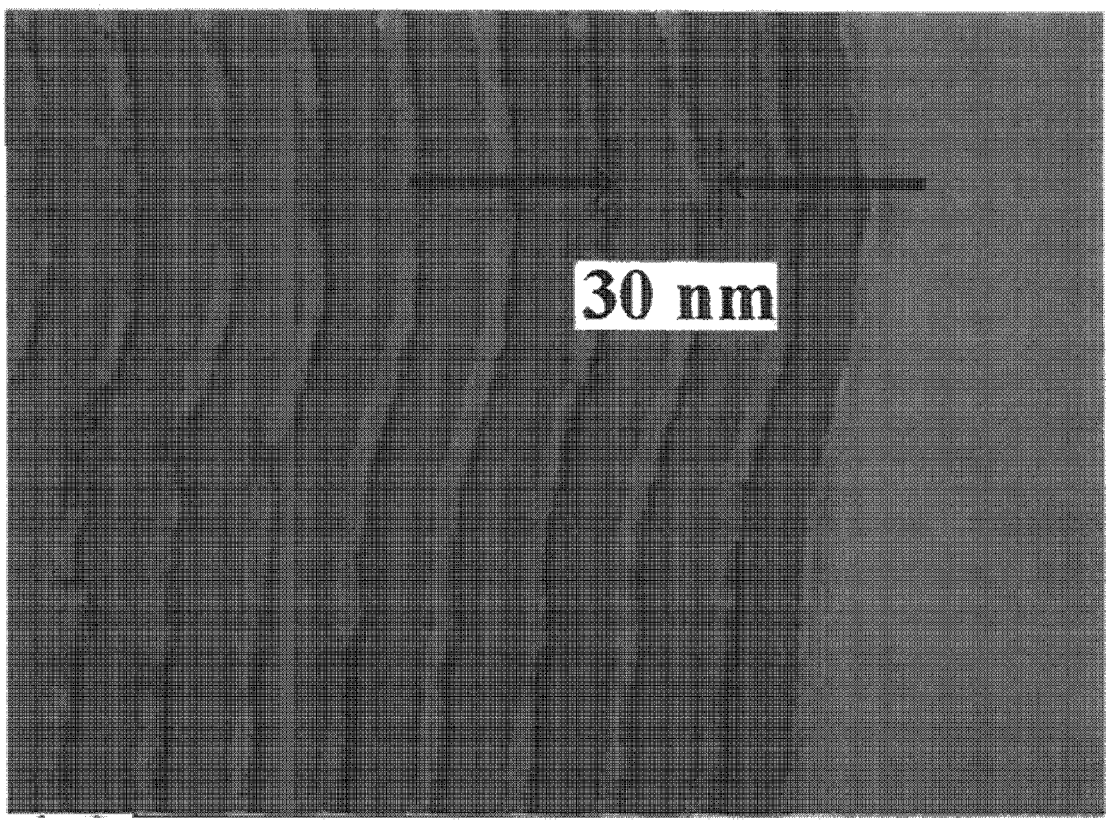
Figure 3C:
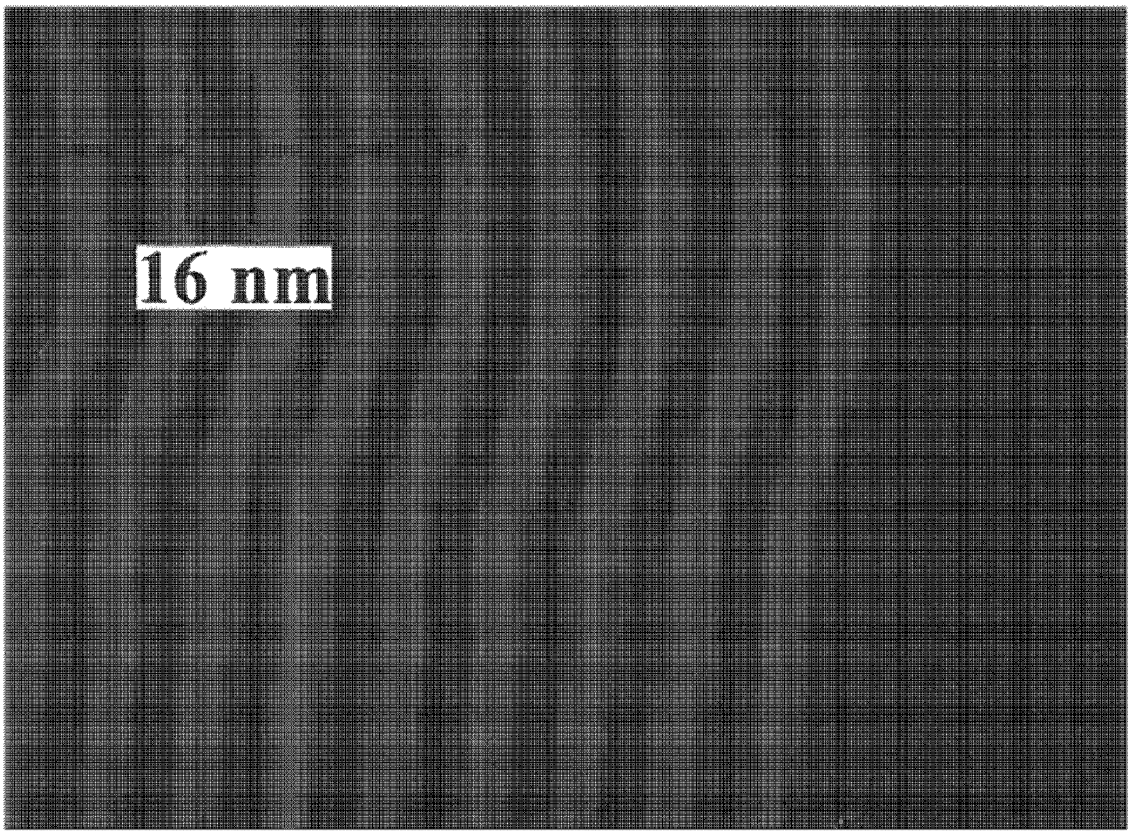
Figure 3D:
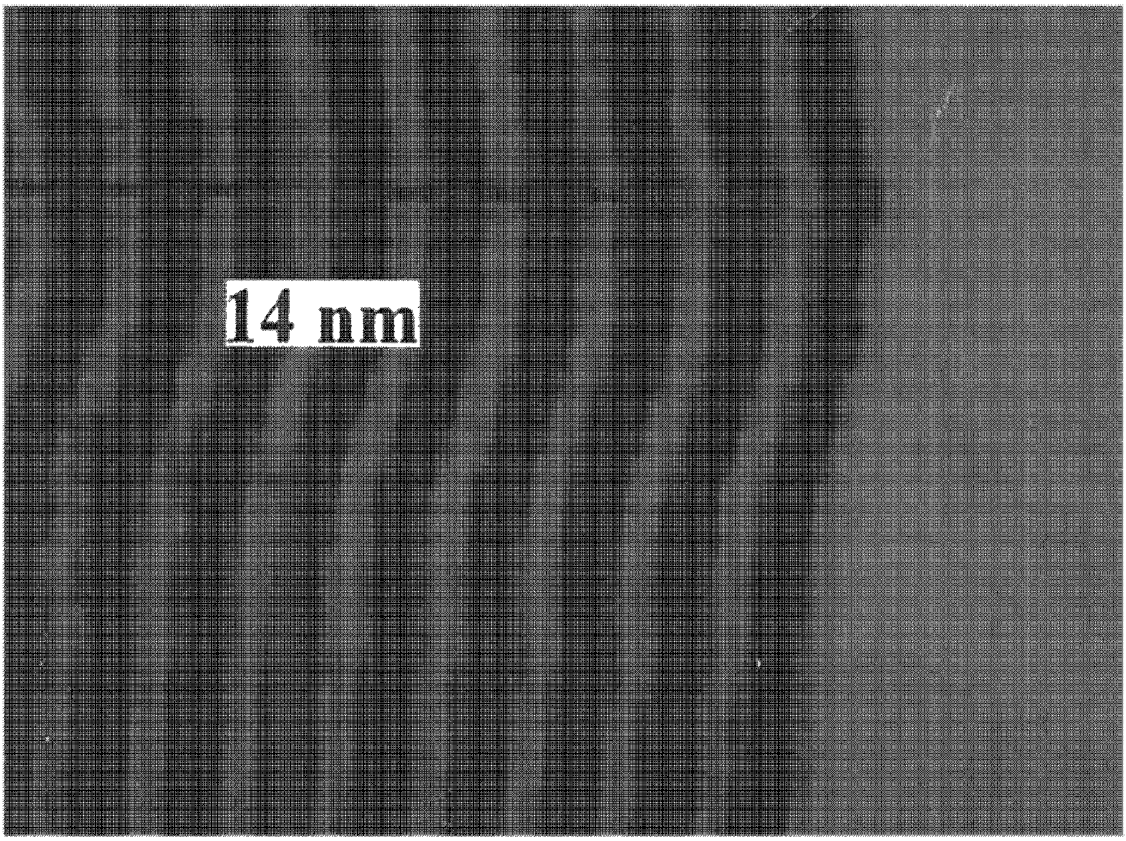

FIG. 1 is a block diagram illustrating a process flow of the method of manufacturing an alloy thin film according to the present invention.

The method of manufacturing an alloy thin film according to the present invention includes a step of forming a multilayer and a step of thermally treating the multilayer.

The step of forming a multilayer may be preferably performed through a plating process or an electroforming process. For example, the step of forming a multilayer may include a process of preparing a plating solution and a current application process of applying a current having two types of pulse waveforms to the plating solution over multiple stages. Here, in the current application process of applying a current having two types of pulse waveforms over multiple stages, a current having a pulse waveform corresponding to plating of a metal of each layer of the multilayer is applied. For example, in the case of a multilayer for forming a copper-nickel alloy such as "copper-nickel-copper-nickel" (1), a current having pulse waveforms of a reduction potential for copper plating and reduction potential for nickel plating is maintained during a desired period and is alternately applied. As a result, a multilayer which has a metal-sandwiched structure and controlled thickness is formed. Here, desorption of hydrogen gas is effectively induced by simultaneously applying ultrasonic pulses, thereby preventing crack generation inside a plating layer. In the case of an "iron-copper-nickel" alloy (2), a multilayer thin film with a nano-scale thickness is formed by sequentially applying, in a pulse current, three types of electric potentials where copper, iron, and nickel are reduced, and, simultaneously, rolling is carried out, resulting in the formation of an alloy.

Alternatively, a layer number and thickness of the multilayer may be controlled by connecting in series a plurality of electrolytic cells to each other and by stepwise or repeatedly transferring and adding an electroforming layer to the electrolytic cells under a DC application condition.

The step of thermally treating the multilayer may be performed when the thickness of each layer is tens of nanometers in size due to the composition of elements in an alloy or interdiffusion does not proceed during an electroforming process. In addition, the step of thermally treating the multilayer may be performed by heating the multilayer in a temperature range in which multi-layered metals are interdiffused.

Preferably, the multilayer is thermally treated while rolling the same. In this case, since interdiffusion may occur at a relatively low temperature by pressure due to rolling, a softening phenomenon due to a high temperature may be prevented, whereby an alloy foil with a homogenous microtexture may be economically produced. In the rolling process, the alloy is rolled to a desired final thickness.

Hereinafter, preferred embodiments of processes of manufacturing (1) a copper-nickel alloy thin film and (2) an iron-nickel-copper alloy thin film are described in detail.

1. Manufacture of Metal Multilayer Using Electroforming Process

First, a plating solution for forming a copper-nickel multilayer was prepared. For example, the plating solution was prepared by dissolving $CuSO_4 \cdot 5H_2O$, $NiSO_4 \cdot 6H_2O$, and $Na_3C_6HO \cdot 2H_2O$ in distilled water. pH was adjusted using $H_2SO_4$ and $NH_4OH$, and electroplating was carried out using two types of pulse waveforms at about 25° C.

Table 1 shows the chemical composition of the plating solution for forming a copper-nickel multilayer.

TABLE 1

| $NiSO_4 \bullet 6H_2O$ | $CuSO_4 \bullet 5H_2O$ | $Na_3C_6HO \bullet 2H_2O$ |
|---|---|---|
| 183.99 | 0.99 | 73.52 |

FIGS. 3*a* to 3*d* and FIG. 4 illustrate transmission electron microscopy (TEM) images of a copper-nickel multilayer.

FIGS. 3*a* to 3*d* illustrate that a thin film-type copper-nickel multilayer is satisfactorily formed by multi-stage pulse plating.

From the aforementioned results, the following facts may be confirmed.

(1) In the layer wherein a $Ni^{2+}$-citrate solution and a $Cu^{2+}Ni^{2+}$-citrate solution are electroplated, a relative content of nickel to copper is dependent upon electroplating conditions such as a solution composition, a pulse current density, control time, temperature, and pH.

(2) The content of copper is higher at a current density of −0.5 $mAcm^{-2}$ than at a current density of −50 $mAcm^{-2}$. In addition, nickel is more easily deposited with increasing pH under the electroplating conditions.

2. Manufacture of Alloy Through Heat Treatment (1) A copper-nickel multilayer having a thickness of 20 nm or less, manufactured as described above, was subjected to vacuum heat treatment for about 6 hours. The vacuum heat treatment caused interdiffusion between a copper layer and nickel layer having nano-scale thicknesses, which was caused by high residual stress in a deposit.

Figure 4:
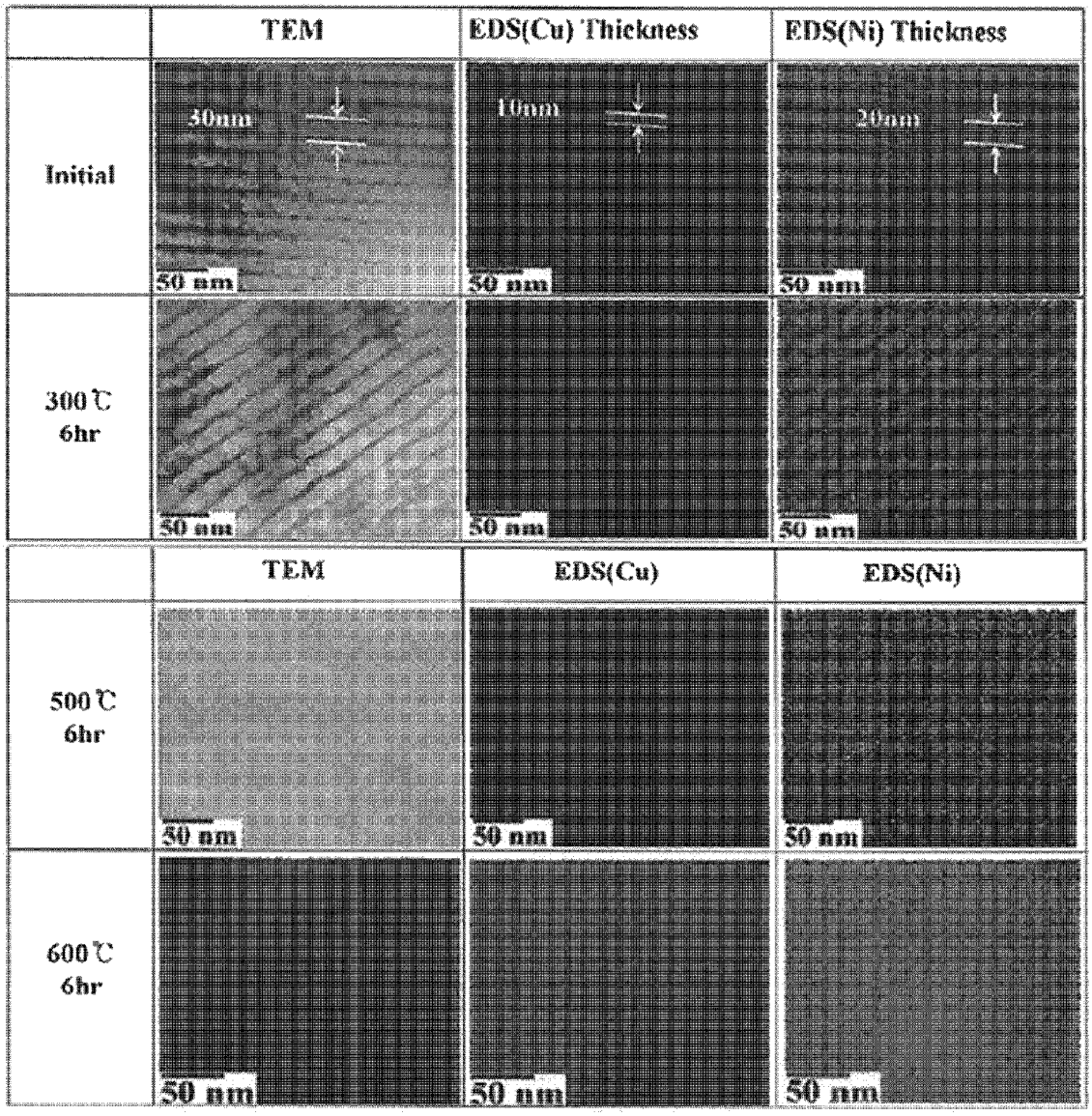
FIG. 4 is a set of photographs illustrating thermal interface instability dependent upon heat treatment temperature.
Figure 5A:
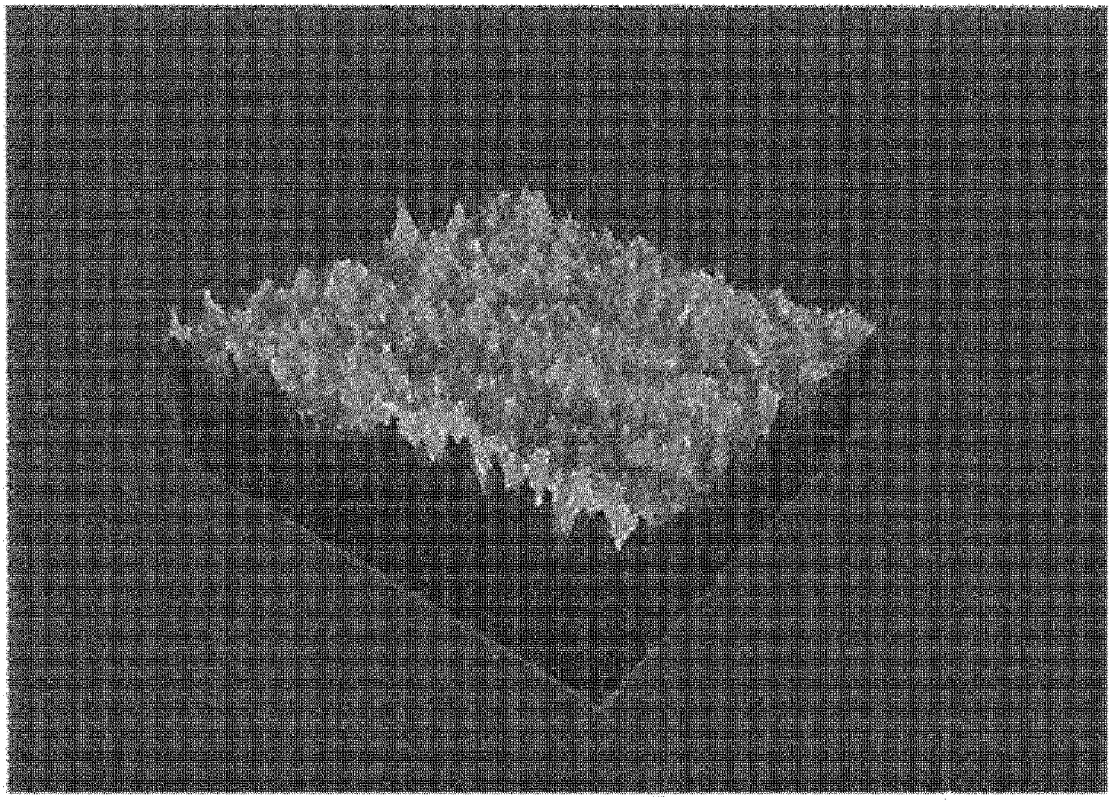
FIGS. 5*a* and 5*b* are photographs illustrating a change in surface morphology dependent upon heat treatment.
Figure 5B:
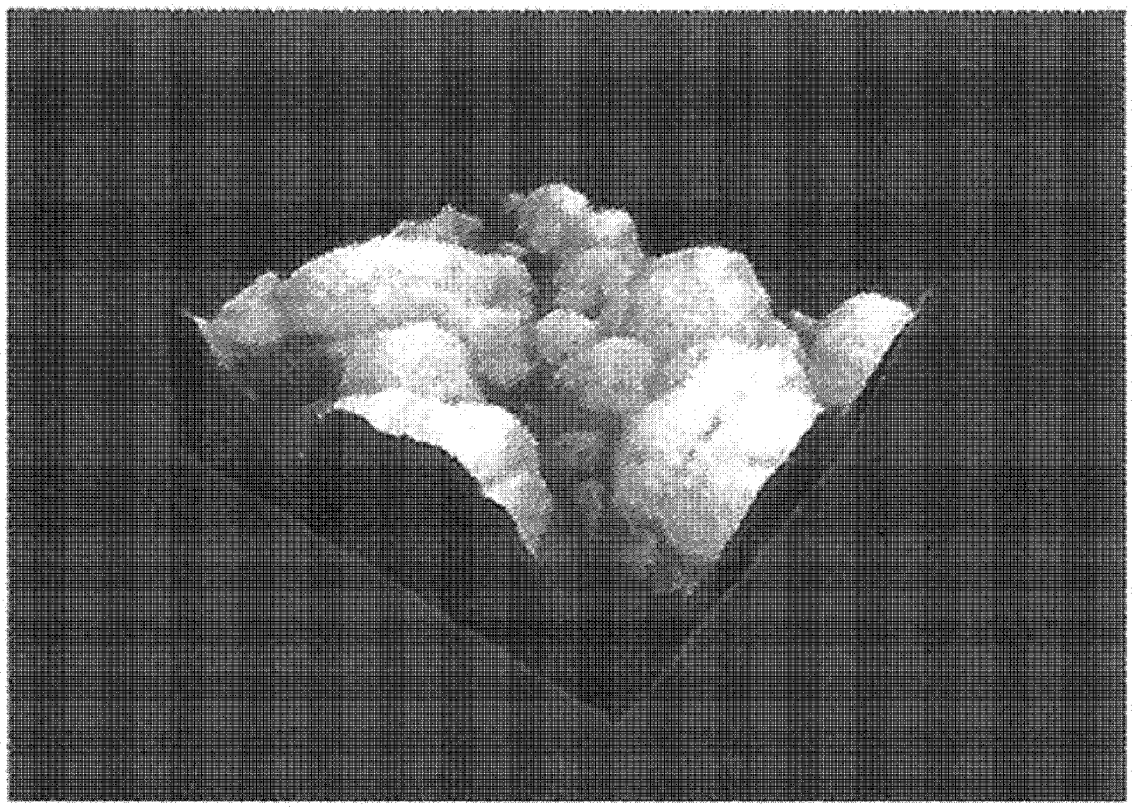
Figure 6A:
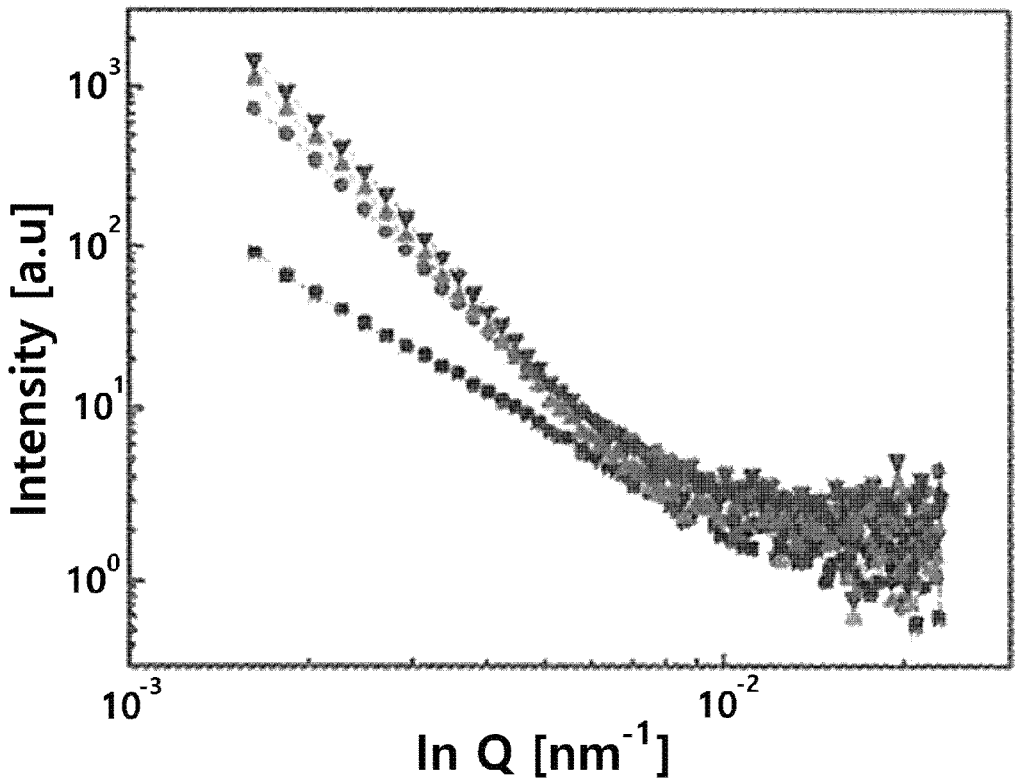
FIGS. 6*a* and 6*b* are a small-angle neutron scattering graph of non-destructively evaluating an interfacial change phenomenon due to progression of interdiffusion dependent upon heat treatment temperature and a graph of an alloy after heat treatment, respectively.
Figure 6B:
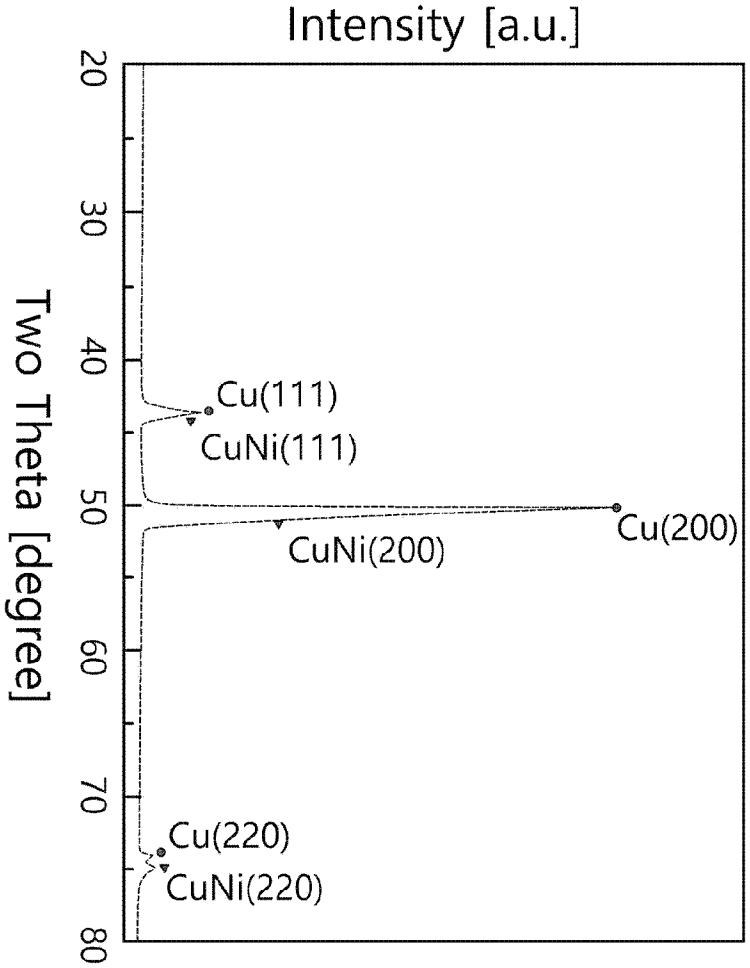

FIG. 4 is a set of photographs illustrating thermal interface instability dependent upon heat treatment temperature. FIGS. 5*a* and 5*b* are photographs illustrating in a change in a surface shape dependent upon heat treatment. FIGS. 6*a* and 6*b* are a small-angle neutron scattering (SANS) graph of non-destructively evaluating an interfacial change phenomenon dependent upon heat treatment temperature and an X-ray diffraction (XRD) graph of an alloy phase generated after heat treatment, respectively.

As illustrated in the drawings, interdiffusion proceeds at an interface of a plating layer with tens of nano-scale thickness with increasing temperature and heat treatment time, whereby a phase interface finally disappears and an alloy is formed.

(2) Combination of Rolling and Heat Treatment are

Each of the manufactured multilayers was rolled while being heated. In this case, a temperature causing interdiffusion in the nano-scale multilayer and annealing time were relatively decreased. For example, in the case of the copper-nickel, interdiffusion occurred at about 400° C., whereby an alloy was produced. The temperature is about 200° C. lower than that in the case wherein annealing was performed without rolling.

While the embodiments of the present invention have been described, those skilled in the art will appreciate that many modifications and changes can be made to the present invention without departing from the spirit and essential characteristics of the present invention.

(3) Manufacture of Metal Alloy Layer by Hot Rolling Combined with Electroforming Process First, a plating solution for manufacturing an iron-nickel-copper multilayer was prepared. For example, a plating solution was prepared by dissolving $FeSO_4$, $NiSO_4$, $CuSO_4$, $H_2SO_4$, $H_3BO_4$, and KOH in distilled water. pH was adjusted using $H_2SO_4$ and KOH, and an electroforming process was carried out using three types of pulse waveforms at about 55° C. Immediately after the electroforming process, the prepared atom-unit multilayer was continuously injected into a roller-type roller mill, and hot rolling was carried out while heating at about 400° C. As a result, an alloy composition became homogenous and, simultaneously, cracks due to hydrogen during plating were removed.

Table 2 shows the chemical composition of the plating solution for forming an iron-copper-nickel multilayer.

TABLE 2

| $FeSO_4$ | $NiSO_4$ | $CuSO_4$ | $H_2SO_4$ | $H_3BO_4$ | KCl |
|---|---|---|---|---|---|
| 97 | 38 | 16 | 25 | 25 | 30 |

Figure 7:
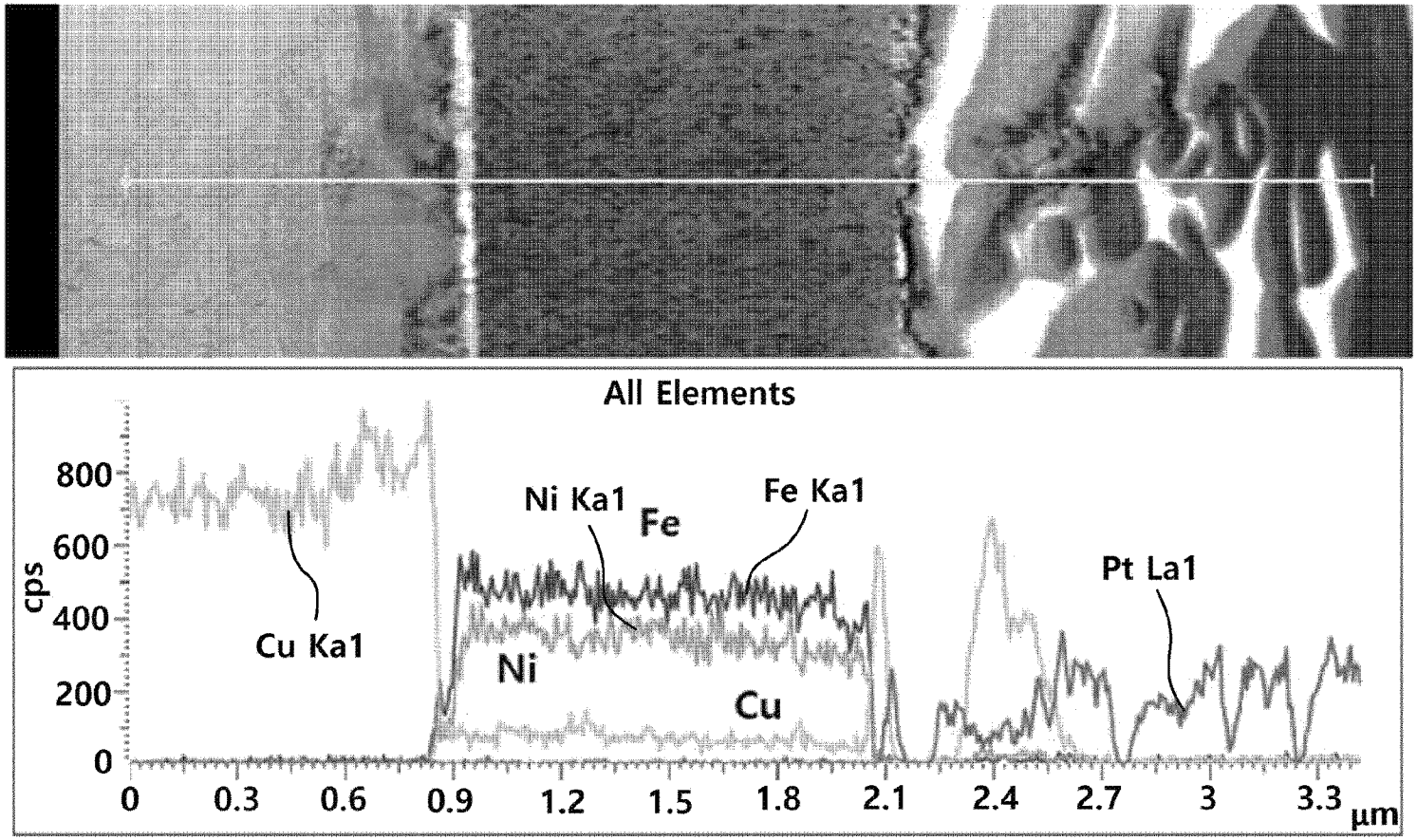
FIG. 7 illustrates scanning electron microscope (SEM) and energy dispersive x-ray (EDX) spectrometer analysis results of a cross section of a Fe—Ni—Cu alloy manufactured in an electroforming process.

FIG. 7 illustrates scanning electron microscope (SEM) and energy dispersive x-ray (EDX) spectrometer analysis results of a cross section of a Fe—Ni—Cu alloy manufactured in an electroforming process. As illustrated in FIG. 7, the thickness of the thin film was about 1 micrometer, and an alloy of Fe-35% Ni-10% Cu was produced.

The invention claimed is:

1. A method of manufacturing an alloy thin film, the method comprising:

(a) a step of electroforming a multilayer that comprises two or more different thin metal film layers in which nano-scale cracks generated by hydrogen generation are controlled; and (b) a step of hot-rolling or thermally treating the multilayer during or after the electroforming of the multilayer such that interdiffusion among the two or more different thin metal film layers is facilitated and nano-scale cracks generated by hydrogen generation are removed by compression, wherein, in step (a), a layer number and thickness of the multilayer are controlled to a nano-sized thickness through application of various types of pulses;

wherein the multilayer of step (a) is manufactured to have a desired alloy composition by alternately, repeatedly laminating different types of thin metal layers, wherein each layer of the different thin metal layers is laminated by applying a pulse current density having various pulse waveforms, different electric potentials, and different pHs, wherein the multilayer is formed using electroforming applying the pulse current density simultaneously with an ultrasonic pulse, wherein the ultrasonic pulse is used to control nano-scale cracks in the multilayer generated by hydrogen generation, and wherein the thermally treating of step (b) is performed during rolling.

2. The method according to claim 1, wherein, in step (a), the layer number and thickness of the multilayer are controlled by connecting a plurality of electrolytic cells in series and stepwise or repeatedly transferring and adding an electroforming layer to the electrolytic cells under a DC application condition.

* * * * *